United States Patent [19]

Schukoff

[11] Patent Number: 4,681,080

[45] Date of Patent: Jul. 21, 1987

[54] DEVICE FOR THE TEMPORARY INTERRUPTION OF THE PRESSURE BUILD-UP IN A FUEL INJECTION PUMP

[75] Inventor: Bruno Schukoff, Graz, Austria

[73] Assignee: A V L Gesellschaft für Verbrennungskraftmaschinen und Messtechnik mbh Prof. Dr.Dr. h.c. Hans List, Graz, Austria

[21] Appl. No.: 800,405

[22] Filed: Nov. 21, 1985

[30] Foreign Application Priority Data

Nov. 23, 1984 [AT] Austria ..... 3721/84

[51] Int. Cl.[4] ..... F02M 45/10

[52] U.S. Cl. ..... 123/506; 123/299; 417/499

[58] Field of Search ..... 123/449, 447, 506, 299, 123/300; 417/494, 499

[56] References Cited

U.S. PATENT DOCUMENTS

| | | | |
|---|---|---|---|
| 2,421,475 | 6/1947 | Beeh | 123/506 X |
| 2,713,310 | 7/1955 | Muraszew | 123/506 X |
| 2,810,375 | 10/1957 | Froehlich et al. | 123/447 |
| 2,918,048 | 12/1959 | Aldinger et al. | 123/506 X |
| 3,677,256 | 7/1972 | Regneault et al. | 123/506 X |
| 3,759,239 | 9/1973 | Regneault et al. | 123/447 X |
| 4,029,071 | 6/1977 | Saito et al. | 123/447 |
| 4,165,723 | 8/1979 | Straubel | 417/499 X |
| 4,449,504 | 5/1984 | Furohashi et al. | 123/447 |

FOREIGN PATENT DOCUMENTS 292382 12/1970 Austria .

*Primary Examiner*—Tony M. Argenbright

*Attorney, Agent, or Firm*—Watson, Cole, Grindle & Watson

[57] ABSTRACT

Devices for dividing the process of fuel injection into two phases, i.e., pre-injection and main injection, with a pressure relief body opening up an expansion space when the fuel injection pump has reached a given level of pressure, are known to be provided with a by-pass line which can shut off by a spring-loaded slide valve. A simpler design of such a pressure relief system is achieved by having the by-pass line lead from the expansion space to a by-pass opening which is located in the cylinder wall of the pressure chamber of the pump and is intermittently covered by the pump plunger, and by making this opening cooperate with control edges on the pump plunger, leaving it uncovered in the injection-free state.

2 Claims, 1 Drawing Figure

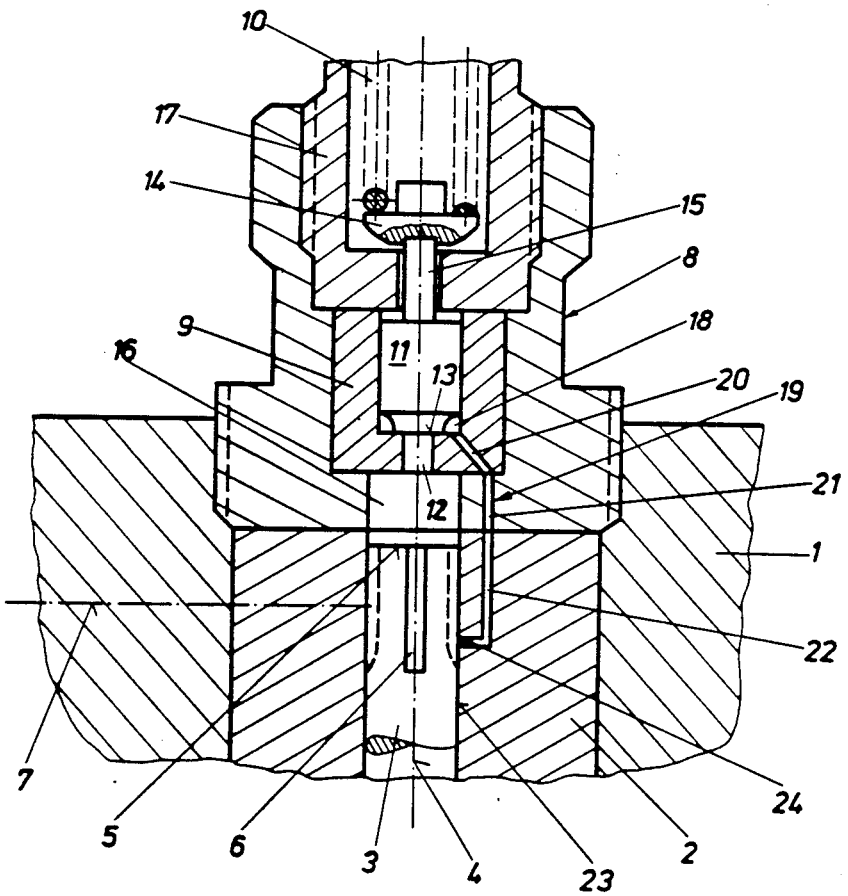
10
17
14
15
8
9
18
16
11
13
20
19
21
12
1
22
7
24
5
6
3
4
23
2

DEVICE FOR THE TEMPORARY INTERRUPTION OF THE PRESSURE BUILD-UP IN A FUEL INJECTION PUMP

BACKGROUND OF THE INVENTION

This invention relates to a device for the temporary interruption of the pressure build-up in a fuel injection pump for internal combustion engines, comprising a pressure relief body which is guided by a guiding part and loaded by a pre-loading force against whose action it will slide up to a given stop under the pressure of the fuel entering from the pressure chamber of the pump, the pressure-loaded area being small in the closed position of the pressure relief body as compared to that in its open position, which body will give access to an expansion space after a given pressure level has been reached, the expansion space being bounded by the pressure relief body and the guiding part, and being depressurized by a separate by-pass line.

The purpose of such temporary interruption of the pressure build-up is a division of the process of injecting fuel into the combustion chamber of an internal combustion engine into a pre-injection phase and a main injection phase, thus influencing the combustion process and reducing combustion noise, above all. As soon as the pressure in the injection system exceeds a certain level determined by the pre-loading force and the pressure-loaded area of the pressure relief body, an expansion space is opened up, usually abruptly, due to the sudden enlargement of the area loaded by pressure, which will lead to a temporary pressure drop in the injection system and a temporary closing of the injection nozzle after its initial opening for pre-injection. When the pressure relief body has reached its maximum displacement the expansion volume will remain constant, and the pressure in the fuel which is constantly being delivered by the injection pump, will rise again, eventually leading to the main injection process.

DESCRIPTION OF THE PRIOR ART

A device of the above type is described in AT-PS No. 292 382, for example, in which the front end of the pressure relief body seals the inlet port in the closed position, the pressure-loaded cross-section being smaller than the total cross-section of the pressure relief body. In order to depressurize the expansion space during the closing process of the pressure relief body the above device is provided with a separate by-pass line in addition to the inlet port, which line can be closed by a spring-loaded slide valve. This slide valve is subject to the load of the fuel pressure in the same way as the pressure relief body itself, but it is actuated at a lower fuel pressure, which will ensure that the by-pass line is closed when the expansion space is opened up. In the injection-free state the slide valve in the by-pass line is open, thus preventing any residual pressure from remaining in the expansion space, whose actual level would be uncontrollable due to leaks and which itself would have uncontrollable effects on the interruption of fuel injection in the subsequent working cycle.

It is a disadvantage of the above device that the additional slide valve and the design measures necessary for actuating and resetting it entail a further complication of the device, in addition to causing further fluctuations in the quantity of fuel delivered, or rather, fluctuations with regard to fuel metering during pre-injection and main injection time, resulting in instabilities during injection and combustion, as a consequence, which will have uncontrollable and undesirable effects on fuel consumption, power output and pollutant emission of the combustion engine.

SUMMARY OF THE INVENTION

It is an object of the present invention to improve a device of the above type in such a way that the fuel injection is divided into a pre-injection and a main injection phase in a simple and reliable way, without any undesirable fluctuations in the quantity of fuel delivered during the individual injection phases.

According to the invention this is achieved by providing that the by-pass line leads from the expansion space to a by-pass opening which is located in the cylinder wall of the pressure chamber of the pump and is intermittently covered by the pump plunger, and by further providing that the by-pass opening cooperate with control edges at the pump plunger and be left open by the plunger in the injection-free phase. After each injection process this by-pass line will ensure a defined depressurization of the expansion space into the pump chamber, thus permitting uniform operating conditions and pre-injections.

The absence of a separate shut-off device will permit the design to be kept very simple, which will also simplify prodution and maintenance. Besides, the absence of additional moving parts will eliminate any further fluctuations in the quantity of fuel delivered.

A preferred variant of the invention with a rotary plunger/distributor pump for fuel injection provides that the by-pass opening directly cooperate with the grooves for fuel supply on the pump plunger, and that the by-pass opening remain open while the fuel is being admitted into the pressure chamber. This will further simplify the pressure relief of the expansion space, permitting old pumps to be refitted in a simple manner.

DESCRIPTION OF THE DRAWING

Following is a more detailed description of the invention as illustrated by the attached drawing presenting a partial sectional view.

The pump housing 1 of a distributor injection pump (not shown here) contains a cylinder liner 2 in which is guided a plunger 3 which moves to and fro in the direction of the axis 4 and rotates around this axis in a manner not shown. At the end 5 next to the pressure chamber 16 the plunger 3 has grooves 6 on its circumference, which grooves 6 cooperate with a fuel supply bore indicated by its axis 7 only, depending on the position angle of the plunger 3. The operating details of the rotary plunger/-distributor pump essentially comprising these components will not be discussed in this context.

Above the cylinder liner 2 a screw part 8 is inserted into the pump housing 1 which part 8 contains a device for the temporary interruption of the pressure build-up. This device comprises a pressure relief body 11 which is guided by a guiding part 9 and is pre-loaded by a spring 10, and which can be moved by the fuel pressure against the action of the spring 10. This pressure relief body 11 has a cylinder shape, with a stepped front end 13 against which the fuel presses via an inlet port 12, the remaining area of this front end closing the inlet port 12—whose cross-section is smaller—in the manner of a valve seat, under the load of spring 10 acting via a spring plate 14 and a pin 15. On the side of the guiding part 9 away from the pressure chamber 16 of the injection pump a sleeve 17 is screwed into the screw part 8, which is used for keeping the guiding part 9 in place, at the same time acting as a ring-shaped stop for the pressure relief body 11.

Starting from the expansion space 18 a by-pass line 19 is provided whose cross-section is smaller than that of the inlet port 12, the expansion space 18 being bounded by the guiding part 9 on the one hand and by the pressure relief body 11 on the other hand which can be pushed up to the stop provided by sleeve 17 against the action of spring 10, by the fuel entering from the pressure chamber 16 through the inlet port 12. The first portion 20 of the by-pass line 19, which is located in the guiding part 9, is followed by connecting bores 21 in the screw part 8 and 22 in the cylinder liner 2; in the area of grooves 6 the by-pass line 19 opens into the interior of the cylinder liner 2 via a by-pass opening 24 in the cylinder wall 23.

This kind of assembly functions as follows. Once the plunger 3 has closed the fuel supply bore indicated by its axis 7 as well as the by-pass opening 24 by means of the lands remaining between the grooves 6 during its upward movement, pressure is being built-up in the pressure chamber 16 and in the remaining part of the injection system connected by injection lines (not shown), while the plunger 3 is continuing its upward movement, which will cause the injection nozzle to open and thus initiate fuel injection when a certain pressure level has been exceeded. After a further increase of pressure by the upward moving plunger 3 a pressure level will be reached in the fuel which is sufficiently high to lift the pressure relief body 11 off its seat, or rather, off the mouth of the inlet port 12, against the action of the spring 10. In this way the entire cross-section of the pressure relief body 11 is suddenly subjected to the fuel pressure, and the pressure relief body 11 is quickly pushed against the stop provided by sleeve 17. The expansion space opening up in this manner will induce a pressure drop throughout the entire injection system, eventually interrupting fuel injection when the pressure has fallen below the closing pressure of the injection nozzle. As the plunger 3 moves still further upwards the level of fuel pressure is rising again, which will cause the injection nozzle to open again for the main injection phase. With the beginning of depressurization at the end of fuel delivery the pressure relief body 11 moves back towards the mouth of the inlet port 12 and seals it off once again.

In the intervals between the individual injection periods the expansion space 18 communicates with the interior of the cylinder liner 2 via the by-pass line 19 and one of the grooves 6 on the plunger 3, and is thus subject to the fuel pressure of the pre-injection phase. During the injection process the by-pass opening 24 remains closed due to a rotation of the plunger 3. This will make sure that no uncontrollable residual pressure will remain in the expansion space 18 during or after the closing action of the pressure relief body 11, which would cause undefined conditions concerning the injection sequence during the subsequent working cycle. As no separate valves are needed in this by-pass line 19 the design of the assembly is very simple, and the amount of fuel to be delivered may be metered precisely.

Like the rotary plunger/distributor pump any other pump design may be fitted with a pressure relief arrangement as specified. Control of the by-pass opening is achieved either by the ordinary control edges at the pump plunger that are required for operating the pump, or by additional edges, depending on the particular pump model in use.

I claim:

1. A device for the temporary interruption of the pressure build-up in a fuel injection pump for internal combustion engines, said pump comprising a pump plunger, a cylinder wall and a hollow guiding part having a wall at one end defining a pressure chamber together with said plunger and said cylinder wall, said guiding part wall having an inlet port in communication with said pressure chamber, a stop at an opposite end of said guiding part, a pressure relief body received within said guiding part for limited sliding movement between said stop and said guiding part wall, a spring acting against said body for imparting a pre-loading force to said body against the pressure of the fuel entering from said pressure chamber through said inlet port, said body having a reduced end at said one end of said guiding part, said reduced end defining an expansion space together with said guiding part which is accessible after a given pressure level is reached, a separate by-pass line in said guiding part leading from said expansion space for depressurizing said space, a by-pass opening in said cylinder wall leading from said by-pass line, said by-pass opening being intermittently covered by said plunger, and said plunger having control edges cooperating with said by-pass opening which is left open by said edges in an injection-free phase.

2. A device according to claim 1, with a rotary plunger/distributor pump for fuel injection, comprising grooves for fuel supply on said pump plunger, wherein said by-pass opening cooperates directly with said grooves for fuel supply, and wherein said by-pass opening remains open while the fuel is being admitted into said pressure chamber.

* * * * *